US012061014B2

(12) United States Patent
Lee et al.

(10) Patent No.: US 12,061,014 B2
(45) Date of Patent: Aug. 13, 2024

(54) EXHAUST DEVICE

(71) Applicant: LG Electronics Inc., Seoul (KR)

(72) Inventors: Sangcheol Lee, Seoul (KR); Wontae Kim, Seoul (KR); Seonghoon Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 362 days.

(21) Appl. No.: 17/429,804

(22) PCT Filed: Feb. 11, 2020

(86) PCT No.: PCT/KR2020/001919

§ 371 (c)(1),
(2) Date: Aug. 10, 2021

(87) PCT Pub. No.: WO2020/171461

PCT Pub. Date: Aug. 27, 2020

(65) Prior Publication Data

US 2022/0128249 A1 Apr. 28, 2022

(30) Foreign Application Priority Data

Feb. 20, 2019 (KR) ..... 10-2019-0020091

(51) Int. Cl.
*F24F 7/007* (2006.01)
*F24C 15/20* (2006.01)

(52) U.S. Cl.
CPC ..... *F24F 7/007* (2013.01); *F24C 15/20* (2013.01); *F24C 15/2071* (2013.01)

(58) Field of Classification Search
CPC ... F24F 7/007; F24F 7/06; F24C 15/20; F24C 15/2071
See application file for complete search history.

(56) References Cited

U.S. PATENT DOCUMENTS

2016/0161133 A1 6/2016 Oh
2016/0273779 A1* 9/2016 Kim ..... F24C 15/2092
2019/0277521 A1 9/2019 Lee et al.

FOREIGN PATENT DOCUMENTS

KR 1222529 B1 * 1/2013
KR 101222529 1/2013
KR 10-1463455 11/2014
(Continued)

OTHER PUBLICATIONS

International Search Report in International Appln. No. PCT/KR2020/001919, dated May 22, 2020, 4 pages (with English translation).
(Continued)

*Primary Examiner* — Allen R. B. Schult
(74) *Attorney, Agent, or Firm* — Fish & Richardson P.C.

(57) ABSTRACT

The present disclosure relates to an exhaust device. The exhaust device according to the concept of the present disclosure includes a base plate, a swirler, a driving motor, and a rotation shaft. The swirler includes a rotating plate in which the rotation shaft is connected to a central portion thereof, and a plurality of blade parts extending from an edge portion of the rotating plate. In this case, the rotating plate may be convexly bent such that the central portion thereof is positioned on the front side than the edge portion.

13 Claims, 7 Drawing Sheets

(56) References Cited

FOREIGN PATENT DOCUMENTS

| | | | | |
|---|---|---|---|---|
| KR | 1020180063590 | | 6/2018 | |
| KR | 1020180122273 | | 11/2018 | |
| WO | WO2014119813 | | 8/2014 | |
| WO | WO-2014119813 | A1 * | 8/2014 | ..... F04D 17/16 |

OTHER PUBLICATIONS

Office Action in Korean Appln. No. 10-2019-0020091, mailed on Aug. 3, 2023, 14 pages (with English translation).

* cited by examiner

EXHAUST DEVICE

CROSS-REFERENCE TO RELATED APPLICATIONS

This application is a National Stage application under 35 U.S.C. § 371 of International Application No. PCT/KR2020/001919, filed on Feb. 11, 2020, which claims the benefit of Korean Patent Application No. 10-2019-0020091, filed on Feb. 20, 2019. The disclosures of the prior applications are incorporated by reference in their entirety.

TECHNICAL FIELD

The present disclosure relates to an exhaust device.

BACKGROUND

In general, an exhaust device is a device that suctions polluted air. Accordingly, the exhaust device is used in factories, homes, restaurants, and the like, where a lot of pollutants are generated. In particular, the exhaust device may be installed in the kitchen of the home to suction polluted air generated during cooking.

In relation to such an exhaust device, the present applicant has applied for Prior Art Document 1.

<Prior Art Document 1>

1. Publication No. 10-2018-0122273 (published on Nov. 12, 2018)

2. Title of the Invention: Local Exhaust Device and Swirler Provided Therein

Prior Art Document 1 includes a vortex forming device (swirler) that rotates to induce intake of external air and forms a vortex. The vortex forming device includes a rotating plate and a wing part disposed to surround the radially outer side of the rotating plate, and the wing part includes a flat portion forming the same plane as the rotating plate and a bent blade formed by bending a portion of the flat portion.

The vortex forming device (hereinafter referred to as the swirler) of Prior Art Document 1 is provided with a flat surface and may be relatively easily deformed by external impact or external force. In particular, there is a problem in that a portion of the swirler coupled to a rotation shaft is relatively thin and flat, so that it is vulnerable to external force.

In addition, one end of the rotation shaft may be coupled to the swirler and the other end of the rotation shaft may be coupled to a driving motor. At this time, as the swirler is provided with the flat surface, there is a problem in that the height of the exhaust device including the driving motor is relatively increased. Accordingly, there is a problem in that a space in which the exhaust device is installed is limited and user inconvenience is caused.

DISCLOSURE

Technical Problem

The present disclosure has been proposed to solve these problems, and aims to provide an exhaust device having a swirler having a shape that prevents deformation caused by external force.

In particular, the present disclosure aims to provide an exhaust device in which the shape of the swirler installation part where the swirler is installed is deformed in correspondence to the swirler, and the drive motor is accommodated in the swirler installation part such that the exhaust device has a relatively small height.

Technical Solution

An exhaust device according to a concept of the present disclosure includes a base plate, a swirler rotatably coupled to a first surface of the base plate positioned on a front side, a driving motor installed on a second surface of the base plate positioned on a rear side and configured to provide power for rotating the swirler, and a rotation shaft installed to pass through the base plate so as to connect the swirler to the driving motor.

The swirler includes a rotating plate in which the rotation shaft is connected to a central portion thereof, and a plurality of blade parts extending from an edge portion of the rotating plate.

In this case, the rotating plate may be convexly bent such that the central portion thereof is positioned on the front side than the edge portion.

In addition, the base plate may include a base body having the first surface and the second surface, and a swirler installation part formed in the base body to accommodate the swirler.

In addition, the swirler installation part may include a stepped portion extending from the base body toward the rear side, and an installation plate convexly extending from the stepped portion toward the front side.

Advantageous Effects

The exhaust device having the above-described configuration according to the embodiment of the present disclosure has the following effects.

As the swirler that generates the flow of air is formed to prevent a change in shape by external force, the exhaust device operates more stably and the user's reliability may be increased.

In particular, there is an advantage in that the weight of the swirler is maintained as it is, and thus the performance is maintained, and it is possible to prevent the deformation caused by external shock or external force through the change in shape.

In addition, the swirler installation part in which the swirler is installed is formed to correspond to the shape of the swirler, and the driving motor is accommodated in the swirler installation part, thereby reducing the overall height of the exhaust device.

Accordingly, the degree of freedom of installation of the exhaust device is increased and a relatively wide cooking space is secured, thereby increasing user convenience.

BEST MODE FOR CARRYING OUT THE INVENTION

Figure 1:
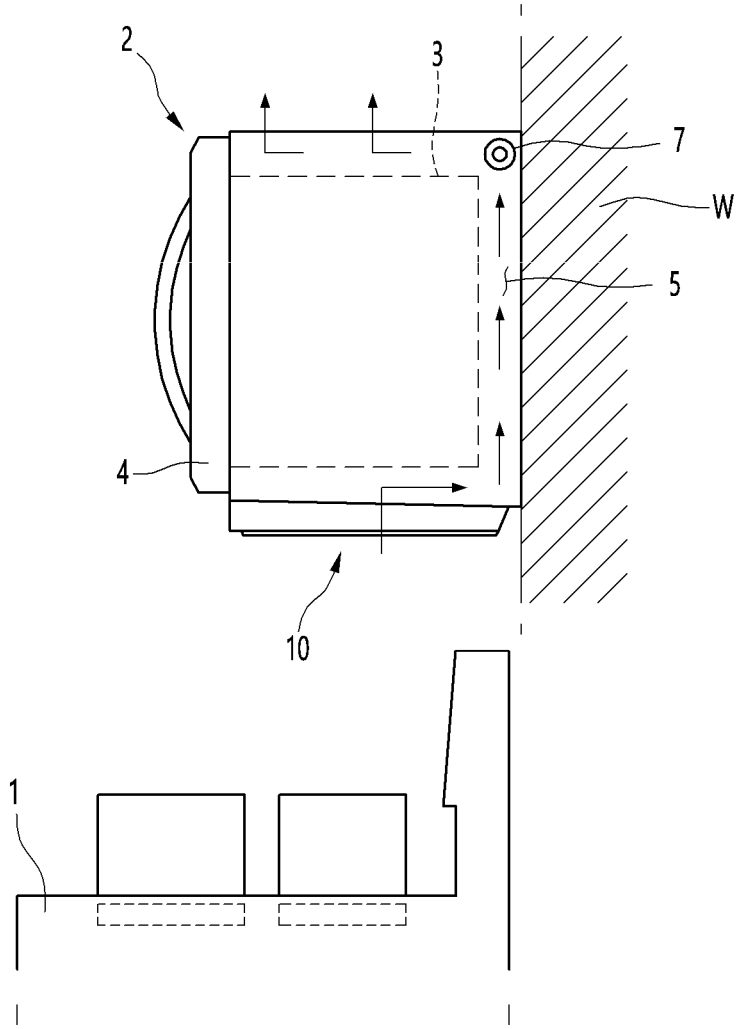
FIG. 1 is a view showing a space in which an exhaust device according to an embodiment of the present disclosure is installed.

Hereinafter, some embodiments of the present disclosure will be described in detail with reference to exemplary drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. These terms are only for distinguishing one component from another, and the nature, order, or sequence of the components is not limited by the terms. When it is described that an element is "coupled to", "engaged with", or "connected to" another element, it should be understood that the element may be directly coupled or connected to the other element but still another element may be "coupled to", "engaged with", or "connected to" the other element between them.

FIG. 1 is a view showing a space in which an exhaust device according to an embodiment of the present disclosure is installed.

As shown in FIG. 1, the exhaust device 10 according to the spirit of the present disclosure may be installed in a kitchen. In particular, the exhaust device 10 may be disposed above a first cooking appliance 1 in which a user cooks a predetermined food. For example, the first cooking appliance 1 may include a gas range.

Accordingly, the exhaust device 10 may suction and discharge polluted air generated when the first cooking appliance 1 is used. In addition, the exhaust device 10 may be coupled to a second cooking appliance 2 installed on a wall W of the kitchen. For example, the second cooking appliance 2 may include a wall-mounted microwave oven.

The second cooking appliance 2 may include a cooking space 3 accommodating food and an air passage 5 communicating with the exhaust device 10. In addition, the second cooking appliance 2 may further include a door 4 configured to open or close the cooking space 3 and a fan 7 installed in the air passage 5.

In this case, the cooking space 3 and the air passage 5 are provided as separate spaces. That is, the cooking operation accommodated in the second cooking appliance 2 and the exhaust operation of the exhaust device 10 may be separately performed.

Referring to an arrow shown in FIG. 1, the air suctioned upward by the exhaust device 10 flows along the air passage 5. The air flows along the air passage 5 and may be discharged to one side. In addition, the air passage 5 may be disposed to communicate with an exhaust hole formed in the wall, such that the polluted air may be discharged to the outside.

In this case, the first cooking appliance and the second cooking appliance are merely exemplary. Accordingly, the exhaust device 10 may be installed in various forms at a required place. In addition, of course, only the exhaust device 10 may be installed alone.

Hereinafter, the exhaust device 10 will be described in detail.

Figure 2:
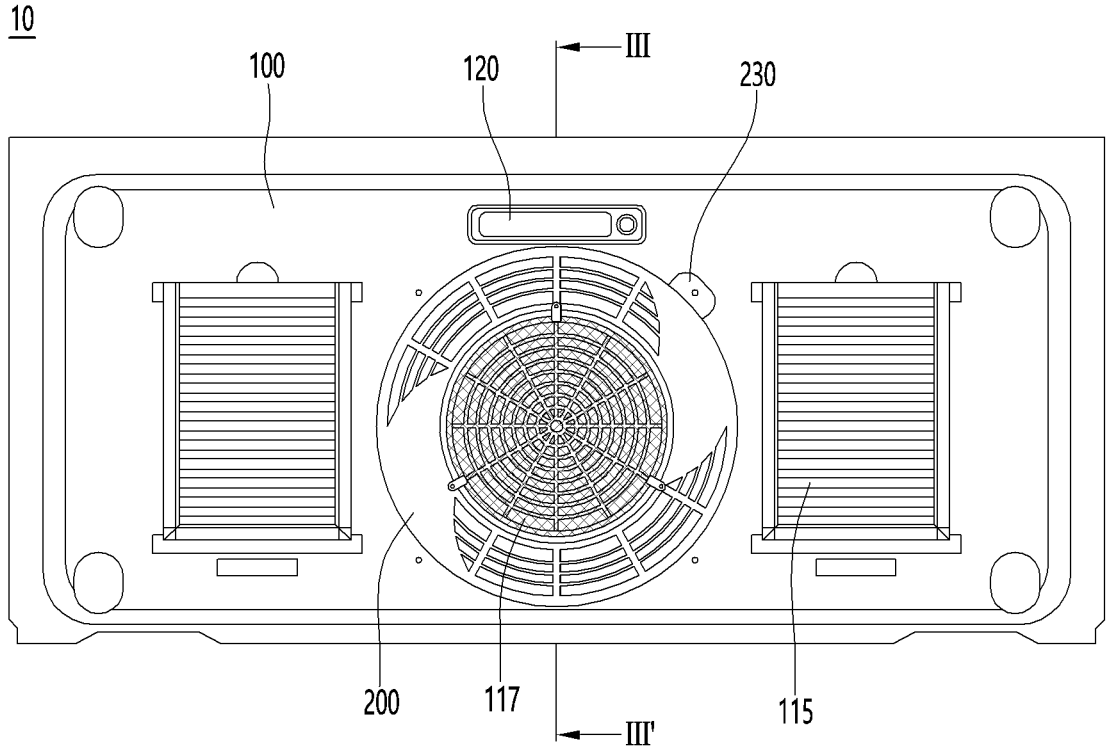
FIG. 2 is a view showing the exhaust device according to an embodiment of the present disclosure.
Figure 3:
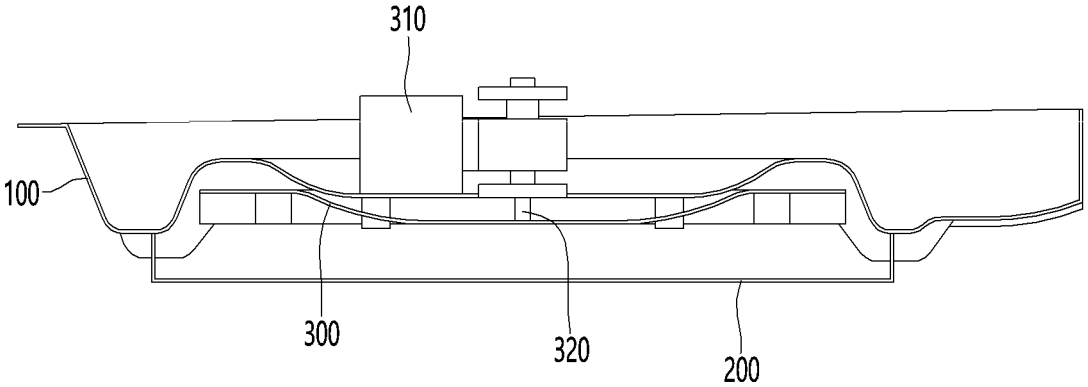
FIG. 3 is a view taken along line of FIG. 2.

FIG. 2 is a view showing the exhaust device according to an embodiment of the present disclosure, and FIG. 3 is a view taken along line of FIG. 2.

As shown in FIGS. 2 and 3, the exhaust device 10 includes a base plate 100 and a swirler 300. The base plate 100 forms the outer appearance of the exhaust device 10 and may be understood as a configuration in which the swirler 300 is installed.

The swirler 300 is rotatably installed to form the flow of air. That is, the swirler 300 may be rotatably coupled to the base plate 100. In addition, the exhaust device 10 includes a driving motor 310 that provides power for rotating the swirler 300 and a rotation shaft 320 that connects the driving motor 310 to the swirler 300.

At this time, the driving motor 310 and the swirler 300 are respectively installed on opposite surfaces of the base plate 100. In detail, the base plate 100 has a first surface and a second surface opposite to each other. In this case, a side on which the first surface is formed is referred to as a front side, and a side on which the second surface is formed is referred to as a rear side.

In addition, the swirler 300 is installed on the first surface of the base plate 100, and the driving motor 310 is installed on the second surface of the base plate 100. In other words, the swirler 300 is installed on the front side of the base plate 100, and the driving motor 310 is installed on the rear side of the base plate 100.

The rotation shaft 320 is installed to pass through the base plate 100 so as to connect the swirler 300 to the driving motor 310. The shape of the swirler 300 and the shape of the base plate 100 on which the swirler 300 is installed will be described in detail later.

In addition, the exhaust device 10 includes a filter bracket 200 that is detachably coupled to the base plate 100. In detail, the filter bracket 200 may be understood as a configuration for protecting the swirler 300.

Accordingly, the filter bracket 200 is coupled to the base plate 100 to cover the swirler 300. As shown in FIG. 2, the swirler 300 is not exposed to the outside by the filter bracket 200. Referring to FIG. 3, the swirler 300 is disposed between the filter bracket 200 and the base plate 100.

That is, the filter bracket 200 is coupled to the first surface of the base plate 100 to cover the swirler 300. In other words, the filter bracket 300 is coupled to the front side of the base plate 100. In this case, the filter bracket 200 may be provided in a circular flat plate as a whole. The filter bracket 200 has various openings and irregularities.

In this case, the bait plate 100 and the filter bracket 200 may be made of different materials and manufactured through different processes. For example, the base plate 100 may be made of steel, and the filter bracket 200 may be made of plastic. In addition, the base plate 100 may be formed on a predetermined flat plate through a machining process, and the filter bracket 200 may be formed through an injection process.

At this time, the filter bracket 200 corresponds to a configuration in which the air flowing by the swirler 300 primarily contacts. That is, there is a relatively high possibility that pollutants are accumulated in the filter bracket 200. Accordingly, the user needs to periodically clean the filter bracket 200.

The exhaust device 1 according to the present disclosure has a structure in which the filter bracket 200 is easily separated from the base plate 100 for user convenience. In detail, the filter bracket 200 may be fitted to the base plate 100.

For example, the filter bracket 200 may be provided with a protruding rib (not shown) protruding toward the base plate 100. The protruding rib may be fitted to the base plate 100, and the filter bracket 200 may be installed in the base plate 100.

In addition, the filter bracket 200 is provided with a fastening rib 230 coupled to the base plate 100 through a fastening member. The fastening rib 230 may be understood as an auxiliary coupling part for fitting. Accordingly, the fastening ribs 230 may be provided in a minimum number. For example, the fastening rib 230 may be provided as one fastening rib.

In addition, the exhaust device 10 is provided with filters 115 and 117 through which the air flowing by the swirler 300 passes. In particular, the filters 115 and 117 may correspond to oil filters configured to filter oil in flowing air. The filter includes a first oil filter 117 installed at one side of the swirler 300 and a second oil filter 115 installed in an auxiliary intake part to be described later.

The first filter 117 is installed in the filter bracket 200 to filter the air flowing into the swirler 300. In particular, the first filter 117 may be formed in a circular shape and installed in the central portion of the filter bracket 200.

In addition, a lighting 120 may be installed in the base plate 100. For example, the lighting 120 may be installed to irradiate the first cooking appliance 1 with light. Accordingly, a user may conveniently cook food in the first cooking appliance 1.

Hereinafter, the base plate 100 will be described in detail.

Figure 4:
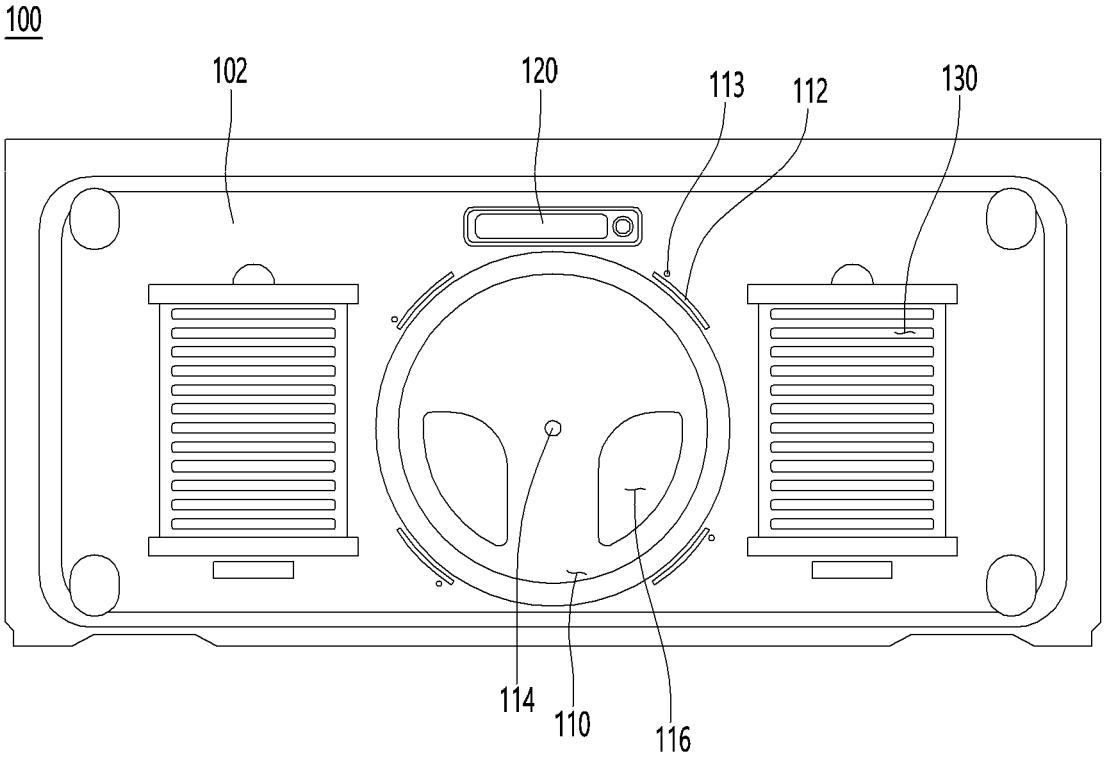
FIG. 4 is a view showing a base plate of the exhaust device according to an embodiment of the present disclosure.

FIG. 4 is a view showing the base plate of the exhaust device according to an embodiment of the present disclosure. The filter bracket 200, the swirler 300, and the filters 115 and 117 of FIG. 2 are omitted in FIG. 4 in order to describe the base plate 100.

As shown in FIG. 4, the base plate 100 may include a base body 102 having a first surface and a second surface. FIG. 4 is a view showing the first surface of the base body 102. The base body 102 is provided as a rectangular flat plate and has various openings and irregularities through various processing processes.

In addition, the base plate 100 is provided with a swirler installation part 110 recessed such that the swirler 300 is accommodated therein. The swirler installation part 110 is formed in a circular shape to correspond to the shape of the swirler 102.

The swirler installation part 110 is formed in a circular shape to correspond to the shape of the swirler 300. A rotation hole 114 through which the rotation shaft 320 of the swirler 300 passes may be formed in the central portion of the swirler installation part 110.

That is, the swirler installation part 110 may be understood as a circular recessed part formed around the rotation hole 114. In addition, the swirler installation part 110 is formed in a circular shape greater than the swirler 300 so as not to interfere with the rotation of the swirler 300.

In addition, a suction port 116 through which air flows is formed in the swirler installation part 110. The suction port 116 may be understood as an opening through which the air passing through the swirler 300 flows through the base plate 100. The shape and number of suction ports 116 may be provided differently depending on the design.

In addition, the base plate 100 is provided with an auxiliary suction port 130 that is opened in the base body 102 so as to be positioned at one side of the swirler installation part 110. As shown in FIG. 4, the auxiliary suction ports 130 may be formed on both sides of the swirler installation part 110, respectively.

The auxiliary suction port 130 may be understood as a configuration that facilitates the flow of air flowing by the swirler 300. In detail, as air flows through the auxiliary suction port 130 as well as the suction port 116, exhaust efficiency may be increased. In addition, the auxiliary suction port 130 may be formed in a shape of an open grill extending to one side.

In addition, the second oil filter 115 may be mounted on the auxiliary suction port 130. In detail, the second oil filter 115 may be installed in front of the auxiliary suction port 130 to filter the air flowing into the auxiliary suction port 130.

In addition, the base body 102 includes a slit 112 that is opened. The slit 112 corresponds to an opening into which at least a portion of the filter bracket 200 is inserted. That is, the slit 112 may be understood as an opening to which the filter bracket 200 is coupled.

As shown in FIG. 4, the slit 112 is opened in an arc shape having a predetermined curvature. In particular, the slit 112 may correspond to an arc of a virtual circle formed around the rotation hole 114. At this time, the virtual circle has a larger diameter than the swirler installation part 110.

In addition, the slit 112 is formed in plurality. For example, as shown in FIG. 4, four slits 112 may be provided. The slits 112 are provided with the same size and shape, and are spaced apart from each other at equal intervals in a circumferential direction. In this case, the number of slits 112 is exemplary.

In addition, the base main body 102 includes a fastening hole 113 that is opened. The fastening hole 113 corresponds to an opening into which a predetermined fastening member passing through the filter bracket 200 is inserted. That is, the fastening hole 113 may be understood as an opening coupled to the fastening rib 230 of the filter bracket 200 by the fastening member.

In this case, the fastening hole 113 is radially spaced apart from the slit 112. In detail, the fastening hole 113 is formed outside the slit 112. That is, the fastening hole 113 is formed outside the swirler installation part 110, and the slit 112 is disposed closer to the rotation hole 114 than the fastening hole 113.

In other words, the rotation hole 114, the slit 112, and the fastening hole 113 are sequentially disposed in one direction. In this case, one direction corresponds to the radially outer side of the circle formed around the rotation hole 114.

In addition, the fastening hole 113 is formed in plurality. For example, as shown in FIG. 4, four fastening holes 113 may be provided. The fastening holes 113 are provided with the same size and shape, and are spaced apart from each other at equal intervals in a circumferential direction. In this case, the number of fastening holes 113 is exemplary.

In addition, the slit 112 and the fastening hole 113 may be provided in the same number. This is for convenience of coupling with the filter bracket 200 to be described later. A coupling protrusion 113 protruding rearward may be formed on the rear surface of the frame light guide 112.

In this case, both the slit 112 and the fastening hole 113 correspond to an opening for coupling with the filter bracket 200. However, the filter bracket 200 is inserted into the slit 112, and the fastening member coupled to the filter bracket 200 is inserted into the fastening hole 113. That is, it can be seen that the filter bracket 200 is fitted through the slit 112 and fixed through the fastening hole 113.

Hereinafter, the swirler installation part 110 will be described in detail.

Figure 5:
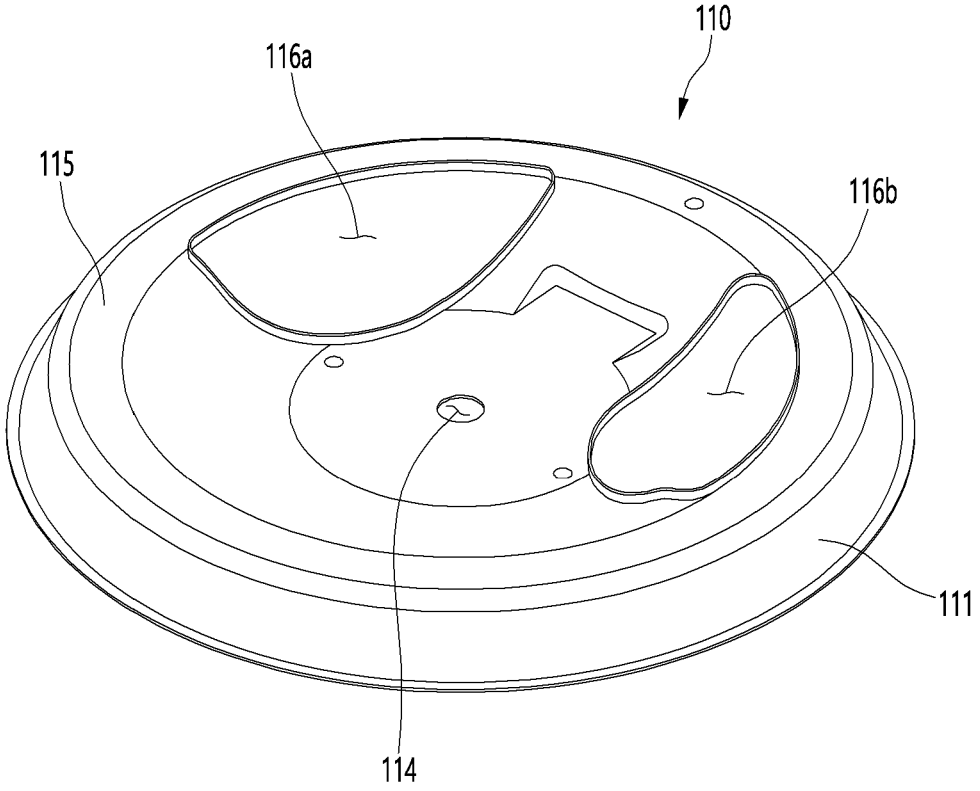
FIGS. 5 and 6 are views illustrating a swirler installation part of the exhaust device according to an embodiment of the present disclosure.
Figure 6:
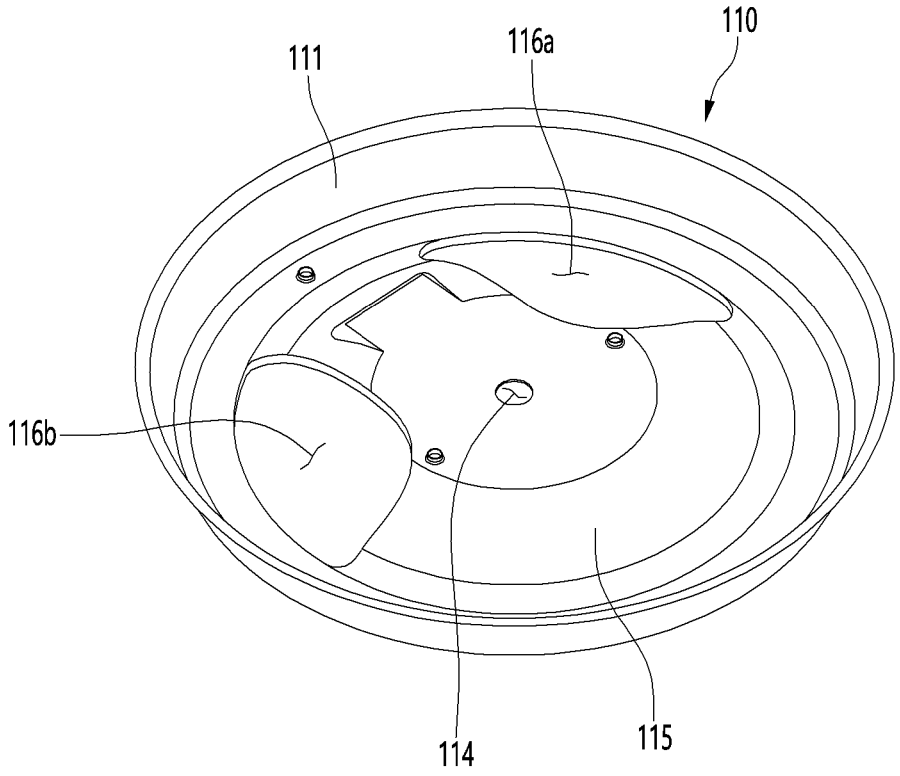

FIGS. 5 and 6 are views illustrating a swirler installation part of the exhaust device according to an embodiment of the present disclosure. FIGS. 5 and 6 are views showing only the swirler installation part 110. This is for convenience of description and the base plate 100 may be integrally formed.

In detail, FIG. 5 is a view showing the swirler installation part 110 when viewed from the second surface side, that is, the rear side. In addition, FIG. 6 is a view showing the swirler installation part 110 when viewed from the first surface side, that is, the front side.

As shown in FIGS. 5 and 6, the swirler installation part 110 has an edge portion recessed to the rear side and a central portion protruding toward the front side. As a whole, the swirler installation part 110 is recessed toward the rear side in a circular shape.

In detail, the swirler installation part 110 includes a stepped portion 111 and an installation plate 115. In particular, the installation plate 115 is formed in a circular shape and spaced rearward apart from the base body 102, and the step portion 111 connects the installation plate 115 to the base body 102.

Accordingly, the step portion 111 is formed to extend rearward from the base body 102. The step portion 111 may be formed to have a predetermined inclination and extend rearward.

In addition, the installation plate 115 is formed to extend frontward from the step portion 111 in a convex shape. Accordingly, the central portion of the installation plate 115 is positioned to protrude frontward than the edge portion connected to the step portion 111. Accordingly, the installation plate 115 is concave from the rear side as shown in FIG. 5.

A rotation hole 114 through which the rotation shaft 320 passes is formed in the central portion of the installation plate 115. The driving motor 310 is disposed at the rear of the installation plate 115, and the swirler 300 is disposed at the front of the installation plate 115. At this time, the driving motor 310 is accommodated in the installation plate 115.

That is, at least a portion of the driving motor 310 is accommodated in the concave installation plate 115. Referring to FIG. 3, as the driving motor 310 is accommodated in the installation plate 115, the driving motor 310 may be disposed on the relatively front side. In other words, the driving motor 310 may be disposed to protrude relatively little toward the rear side.

As a result, as the driving motor 310 is accommodated in the installation plate 115, the height of the exhaust device 100 may be lowered. As shown in FIG. 1, as the height of the exhaust device 100 decreases, a cooking space may be formed more comfortably. That is, as the height of the exhaust device 100 decreases, user convenience may be increased and the exhaust device 100 may be installed even in a narrower space.

In addition, the above-described suction port 116 is formed in the installation plate 115. The suction port includes a first suction port 116*a* and a second suction port 116*b* spaced apart from each other. In this case, the driving motor 310 may be disposed between the first suction port 116*a* and the second suction port 116*b*.

In particular, the first and second suction ports 116*a* and 116*b* may be formed at one side of the installation plate 115. In detail, assuming that the installation plate 115 is divided in half, the first and second suction ports 116*a* and 116*b* are formed only at one side of the installation plate 115, that is, a semicircular portion. The driving motor 310 is disposed in a semicircular portion in which the first and second suction ports 116*a* and 116*b* are formed.

Such a structure is to efficiently form a vortex by the swirler 300. Hereinafter, the shape of the swirler 300 will be described in detail.

Figure 7:
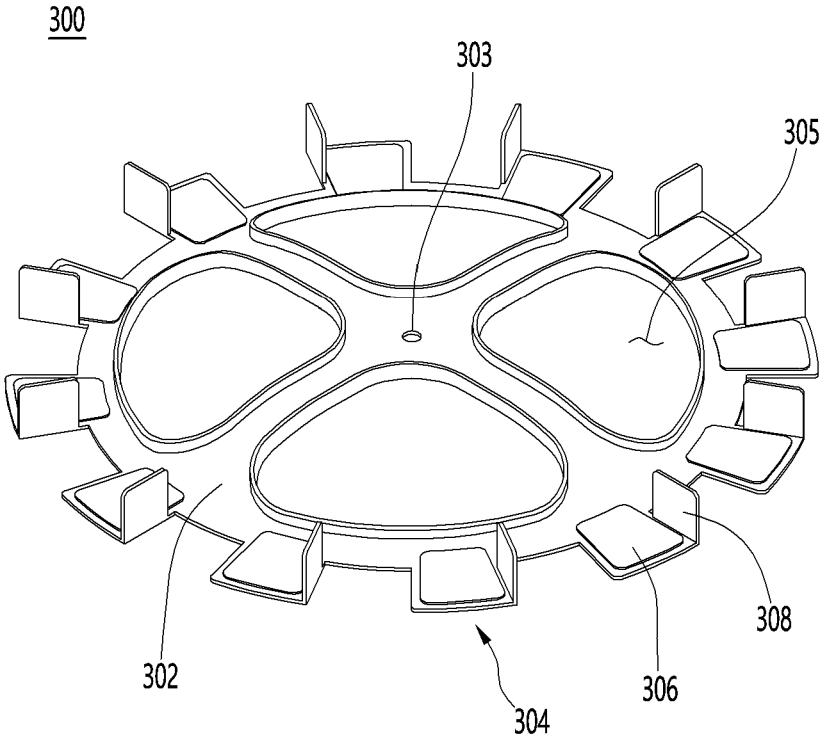
FIGS. 7 and 8 are views illustrating a swirler of the exhaust device according to an embodiment of the present disclosure.
Figure 8:
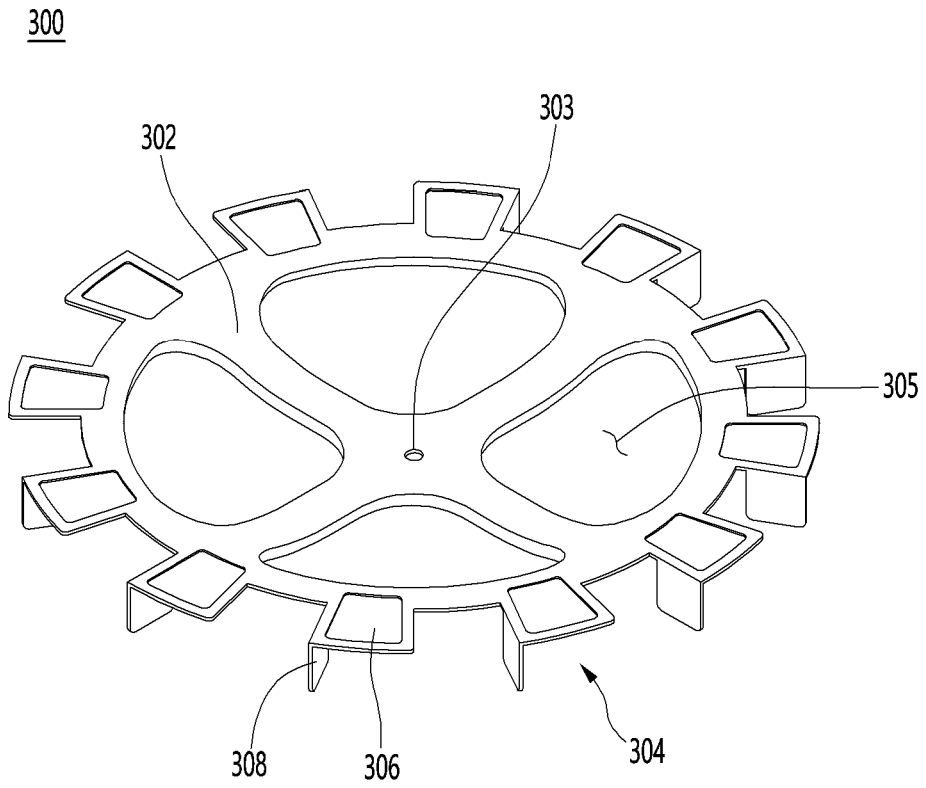

FIGS. 7 and 8 are views illustrating the swirler of the exhaust device according to an embodiment of the present disclosure.

As shown in FIGS. 7 and 8, the swirler 300 includes a rotating plate 302 and a plurality of blade parts 304 extending from the edge portion of the rotating plate 302. In addition, a swirler rotation hole 303 to which the rotation shaft 310 is connected is opened in the central portion of the rotation plate 302.

Accordingly, the swirler 300 may be disposed in the swirler installation part 110 such that the swirler rotation hole 303 matches the rotation hole 114. The swirler 300 is provided in a circular shape accommodated in the swirler installation part 110 as a whole. In detail, the rotating plate 302 may be provided in a circular shape, and the plurality of blade parts 304 may be cut at the edge portion of the rotating plate 302.

At this time, the rotating plate 302 is convexly bent such that the central portion thereof is positioned on the front side than the edge portion. That is, the rotating plate 302 is formed in a shape corresponding to that of the installation plate 115 in FIG. 7. In addition, it can be understood that FIG. 7 shows the swirler 300 when viewed from the front side, and FIG. 8 shows the swirler 300 when viewed from the rear side.

In summary, the swirler 300 shown in FIG. 8 may be disposed and coupled to the lower portion of the swirler installation part 110 shown in FIG. 5. In addition, the swirler 300 shown in FIG. 7 may be disposed and coupled to the upper portion of the swirler installation part 110 shown in FIG. 6.

At this time, one end of each of the plurality of blade parts 304 is bent toward the front side. In detail, each of the blade parts 304 includes a first blade part 306 extending from the rotating plate 302 and a second blade part 308 extending frontward from the first blade part 306.

In other words, the rotating plate 302 is provided in a shape of a disk in which the swirler rotation hole 303 is formed in the central portion. The first blade part 306 extends radially outwardly away from the central portion of the rotating plate 302 at the edge of the rotating plate 302.

At this time, the first blade part 306 is formed to have a predetermined thickness in a circumferential direction. Accordingly, one first blade part 306 has both ends extending from the rotating plate 302. At this time, the second blade part 308 extends frontward from one of both ends of the first blade part 306.

That is, one end of the first blade part 306 is provided so as not to be bent frontward. Accordingly, it can be understood that the first blade part 306 and the second blade part 308 are provided in the same number.

In this case, the length of the second blade part 308 extending frontward from the first blade part 306 is the same as the distance between the edge portion and the central portion of the rotating plate 302 spaced frontward apart from each other. Referring to FIG. 3, it can be seen that the central portion of the swirler 300 is disposed on the same line as the front of the blade part 304 in the horizontal direction.

In addition, the rotating plate 302 includes a plurality of swirler flow holes 305 opened between the swirler rotation hole 303 and the plurality of blade parts 304. At this time, a portion of the rotating plate 302 forming the plurality of swirler flow holes 305 may be bent toward the front side.

Such a shape may prevent the swirler 300 from being deformed by external force. In detail, the deformation of the swirler 300 may be prevented by the force of bending or twisting the swirler 300 frontward or rearward.

In addition, the swirler installation part 110 is provided in a shape corresponding to the swirler 300. Accordingly, the swirler 300 may be more efficiently accommodated in the swirler installation part 110. In addition, the driving motor 320 may be accommodated in the swirler installation part 110 to reduce the height of the exhaust device 10.

The invention claimed is:

1. An exhaust device comprising:

a base plate;

a swirler rotatably coupled to a first surface of the base plate positioned on a front side;

a driving motor installed on a second surface of the base plate positioned on a rear side and configured to provide power for rotating the swirler; and a rotation shaft installed to pass through the base plate so as to connect the swirler to the driving motor, wherein the swirler comprises:

a rotating plate in which the rotation shaft is connected to a central portion thereof, and a plurality of blade parts extending from an edge portion of the rotating plate, wherein the rotating plate is convexly bent such that the central portion thereof is positioned further on the front side than the edge portion, and wherein the rotating plate comprises:

a swirler rotation hole configured to allow the rotation shaft to pass therethrough, and a plurality of swirler flow holes defined between the swirler rotation hole and the plurality of blade parts, wherein a portion of the rotating plate defining the plurality of swirler flow holes is bent toward the front side.

2. The exhaust device of claim 1, wherein the base plate comprises:

a base body having the first surface and the second surface; and a swirler installation part formed in the base body to accommodate the swirler.

3. The exhaust device of claim 2, wherein the swirler installation part comprises:

a stepped portion extending from the base body toward the rear side; and an installation plate convexly extending from the stepped portion toward the front side.

4. The exhaust device of claim 3, wherein a rotation hole through which the rotation shaft passes is formed in a central portion of the installation plate, and wherein the driving motor is disposed at the rear side of the installation plate such that the driving motor and the rotating plate are connected to each other by the rotation shaft, and the rotating plate is disposed at the front side of the installation plate.

5. The exhaust device of claim 4, wherein at least a portion of the driving motor is accommodated in the rear side of the installation plate.

6. The exhaust device of claim 2, wherein the swirler installation part has an edge portion recessed toward the rear side and a central portion protruding toward the front side.

7. The exhaust device of claim 2, wherein the swirler installation part comprises a suction port, and wherein the base plate further comprises an auxiliary suction port that is opened in the base body so as to be positioned at one side of the swirler installation part.

8. The exhaust device of claim 7, wherein the suction port comprises a first suction port and a second suction port spaced apart from each other, and wherein the driving motor is disposed between the first suction port and the second suction port.

9. The exhaust device of claim 1, wherein the plurality of blade parts each have one end bent toward the front side.

10. The exhaust device of claim 1, wherein the rotating plate is provided in a circular shape, and wherein the plurality of blade parts are formed by cutting the edge portion of the rotating plate.

11. The exhaust device of claim 1, wherein each of the blade parts comprises:

a first blade part extending away from the central portion of the rotating plate; and a second blade part extending frontward from one of both ends of the first blade part extending from the rotating plate.

12. The exhaust device of claim 11, wherein a number of the first blade parts and a number of second blade parts in the plurality of blade parts are the same as each other.

13. The exhaust device of claim 12, wherein a length of the second blade part extending frontward from the first blade part is the same as a distance between the edge portion and the central portion of the rotating plate spaced frontward apart from each other.

* * * * *